United States Patent [19]

Duraiswamy et al.

[11] 4,166,786

[45] Sep. 4, 1979

[54] PYROLYSIS AND HYDROGENATION PROCESS

[75] Inventors: Kandaswamy Duraiswamy, Sterling, Va.; Bruce L. Winter, Claremont, Calif.

[73] Assignee: Occidental Petroleum Corporation, Los Angeles, Calif.

[21] Appl. No.: 859,852

[22] Filed: Dec. 12, 1977

Related U.S. Application Data

[63] Continuation-in-part of Ser. No. 700,048, Jun. 25, 1976, abandoned.

[51] Int. Cl.[2] ..... C10G 1/00; C10J 3/16

[52] U.S. Cl. ..... 208/8 R; 48/210; 48/197 R; 208/11 R

[58] Field of Search ..... 208/8, 11 R; 48/210, 48/197 R

[56] References Cited

U.S. PATENT DOCUMENTS

| | | | |
|---|---|---|---|
| 2,487,577 | 11/1949 | Stanley | 208/236 |
| 2,694,623 | 11/1954 | Wilty et al. | 48/197 R |
| 3,086,853 | 4/1963 | Brandberg | 48/197 R |
| 3,224,954 | 12/1965 | Schlinger et al. | 208/11 R |
| 3,617,513 | 11/1971 | Wilson et al. | 208/8 |
| 3,839,186 | 10/1974 | Berger | 208/8 |
| 3,988,237 | 10/1976 | Davis et al. | 48/210 |

FOREIGN PATENT DOCUMENTS

| | | | |
|---|---|---|---|
| 751163 | 5/1976 | South Africa | 208/8 |

*Primary Examiner*—Delbert E. Gantz
*Assistant Examiner*—William G. Wright
*Attorney, Agent, or Firm*—Christie, Parker & Hale

[57] ABSTRACT

In a continuous process for recovery of values from a solid carbonaceous material, the carbonaceous material is pyrolyzed in the presence of a particulate source of heat to yield a particulate carbon containing residue of pyrolysis and volatilized hydrocarbons while simultaneously the volatilized hydrocarbons are hydrogenated. The particulate source of heat is formed by oxidizing carbon in the solid residue to heat the particles. Hydrogen for hydrogenation is obtained by reacting at least a portion of the hot particulate carbon containing residue of pyrolysis with steam prior to feeding the hot particulate residue to the pyrolysis reaction zone. Steam and/or carbon dioxide can be introduced into the pyrolysis reaction zone to react with carbon containing residue contained therein. The particulate source of heat can be introduced to the pyrolysis reaction zone over an overflow weir. The hydrogen and the particulate source of heat can be formed simultaneously in an oxidation-conversion zone. The volatilized hydrocarbons can be further hydrogenated in a vapor hydrogenation zone.

67 Claims, 7 Drawing Figures

PYROLYSIS AND HYDROGENATION PROCESS

CROSS-REFERENCES

This application is a continuation-in-part of co-assigned and co-pending U.S. patent application Ser. No. 700,048, filed June 25, 1976 now abandoned; and is related to co-assigned U.S. patent application Ser. No. 699,993, filed June 25, 1976 now abandoned; and is related to co-assigned and copending U.S. patent application Ser. No. 858,294, filed Dec. 7, 1977, by K. Durasiwamy, and entitled "Production of Hydrogenated Hydrocarbons". Each of these three patent applications is incorporated herein by this reference.

BACKGROUND OF THE INVENTION

This invention is for a process for recovery of fluid hydrocarbons from solid carbonaceous materials by the pyrolysis of the carbonaceous material.

Hydrocarbons resulting from pyrolysis of solid carbonaceous materials, such as coal and oil shale, usually are of relatively low economic value due to their high carbon to hydrogen ratio and tendency to self-polymerize due to the presence of many unsaturated alkene and alkyne bonds. Therefore, to improve the economics of the pyrolysis processes, the low value hydrocarbons typically are hydrogenated in a hydrogenation reactor with hydrogen gas produced in a hydrogen generating plant after they are recovered from the effluent stream from the pyrolysis reaction zone. This is an expensive process due to the operating and capital costs associated with the hydrogen gas generating plant and the hydrogenation reactor. Sometimes the low value hydrocarbons are not hydrogenated until after they are cooled and condensed in a product recovery operation. This is thermally inefficient unless the hydrocarbons are reheated, and reheating is both expensive and wasteful of thermal energy.

When catalytic hydrogenation is used, the liquid products generally are subjected to a solids removal step wherein carbon containing residue of pyrolysis and ash contaminants of very small particle sizes are removed from the liquids. The cost and efficiency of this step is strongly dependent on the quality of the liquids. Solids contaminant removal improves in terms of efficiency and costs as the quality of the liquids improves. Therefore, it would be beneficial to hydrogenate the hydrocarbon product before solids removal.

Squires in U.S. Pat. No. 3,855,070 discloses a process in which coal is pyrolyzed to yield char and hydrocarbons while the hydrocarbons are simultaneously hydrogenated. In Squires' process, the heat for pyrolysis is obtained from hot particulate char, and the hydrogen for the hydrogenation reaction is obtained by presumably reacting a portion of the product char with steam in a fast fluidized bed. This process has high capital and operating costs because of the need for two char loops, one for heating char used as the hot particulate source of heat and a second loop for producing hydrogen gas by reacting steam with char.

Therefore, there is a need for an efficient low cost process for the recovery of fluid hydrocarbons from coal where the fluid hydrocarbons have been upgraded by hydrogenation.

SUMMARY OF THE INVENTION

This invention is for a continuous process for recovery of values from a carbonaceous material feed with the above features. In this process, particulate carbon containing residue resulting from pyrolysis of the carbonaceous material feed is oxidized in an oxidation zone in the presence of a source of oxygen preferably in the substantial absence of unpyrolyzed carbonaceous material to produce hot particulate carbon containing residue and a combustion gas. The carbon containing residue and combustion gas are passed from the oxidation zone to a separation zone in which the hot particulate carbon containing residue is separated from the combustion gas. Hydrogen gas for hydrogenation is then formed in a conversion zone by reacting at least a portion of the separated hot particulate carbon containing residue with steam in the substantial absence of unpyrolyzed carbonaceous material. Next, the carbonaceous material feed, hot carbon containing residue, including carbon containing residue from the conversion zone, and hydrogen gas from the conversion zone are combined in a pyrolysis reaction zone in which the carbonaceous material feed is pyrolyzed while simultaneously pyrolysis products of the carbonaceous material are hydrogenated. Steam can be injected into the pyrolysis reaction zone to react with the hot particulate char contained therein to generate additional hydrogen gas for the hydrogenation of the volatilized hydrocarbons resulting from the pyrolysis of the coal. Also, carbon dioxide can be introduced into the pyrolysis reaction zone. The effluent pyrolysis product stream from the pyrolysis reaction zone contains a particulate carbon containing residue of pyrolysis of the carbonaceous material and a vapor mixture comprising hydrogenated volatilized hydrocarbons.

In order to recover the hydrocarbons resulting from the pyrolysis of the carbonaceous material feed, the particulate carbon containing residue is separated from the vapor mixture. In one version of this invention, the vapor mixture is fed to a vapor hydrogenation zone containing a catalyst. In the vapor hydrogenation zone, volatilized hydrocarbons are further hydrogenated by the hydrogen gas in the vapor mixture withdrawn from the pyrolysis reaction zone. Additional hydrogen gas may be added to the vapor hydrogenation zone to increase the degree of hydrogenation of the hydrocarbons.

In another version of this invention, the steps of oxidizing particulate residue of pyrolysis and forming hydrogen gas occur simultaneously in a combined oxidation-conversion zone preferably in the substantial absence of unpyrolyzed carbonaceous material, thereby eliminating the need for two zones. Preferably, substantially pure oxygen is used in this embodiment to oxidize the carbon containing residue so that nonreactive components of air, such as nitrogen, are not fed to the pyrolysis reaction zone along with the hydrogen gas.

The pyrolysis reaction zone has an operating temperature of from about 600° F. to about 2000° F., a pressure of less than about 10,000 psig, and a solids residence time of less than about one hour. Thus, the hydrocarbons are in the vapor phase during hydrogenation. Preferably, the pyrolysis reaction zone has an operating temperature of from about 600° to about 1400° F. and, more preferably, from about 900° to about 1400° F., a pressure of from about 450 to about 3500 psig, and a residence time of from about 0.5 to about 3 seconds in order to maximize the amount of liquid hydrocarbons produced.

This process exhibits many advantages over the prior art methods. For example, because hydrogen for the hydrogenation step is obtained directly from circulating particulate carbon containing residue, a separate source of hydrogen is not required. In addition, because pyrolysis and hydrogenation occur in a single reaction stage, the expense and maintenance problems associated with separate pyrolysis and hydrogenation reactors are not incurred. By immediately hydrogenating the hydrocarbons resulting from the pyrolysis of the carbonaceous material while in the vapor phase, favorable kinetics result. An advantage of this process, as compared to the process of Squires disclosed in U.S. Pat. No. 3,855,070, is that the same solid residue of pyrolysis is used for producing hydrogen gas as is used as the particulate source of heat in the pyrolysis reaction zone. Thus, two separate loops are not required. This reduces the capital and operating costs of the process.

DRAWINGS

These and other features, aspects and advantages of the present invention will become better understood with reference to the following description, appended claims, and accompanying drawings, wherein:

FIG. 1 schematically shows a process embodying features of this invention;

FIG. 2 schematically shows another process embodying features of this invention;

FIGS. 3-6 are elevational views, partly in section, of pyrolysis reactors useful for practicing this invention; and FIG. 7 is a flow sheet of a bench scale unit used to demonstrate features of this invention.

DETAILED DESCRIPTION OF THE INVENTION

According to the present invention, there is provided a continuous process for economical recovery of hydrocarbons from solid carbonaceous materials and the upgrading of these hydrocarbons by hydrogenation. In this process, particulate carbon containing residue of pyrolysis of a solid carbonaceous material, and preferably particulate carbon containing residue resulting from pyrolysis of the carbonaceous material treated by this process, is oxidized in an oxidation zone preferably in the substantial absence of unpyrolyzed carbonaceous material to produce hot particulate char. This hot particulate carbon containing residue is then reacted with steam to produce hydrogen gas in a conversion zone. The hydrogen gas and a particulate source of heat, including hot particulate carbon containing residue formed in the conversion zone, are combined with a carbonaceous material feed in a pyrolysis reaction zone. In the pyrolysis reaction zone, the carbonaceous material is pyrolyzed to produce a vapor mixture comprising volatilized hydrocarbons and additional particulate carbon containing residue of pyrolysis and the volatilized hydrocarbons which are simultaneously hydrogenated by the hydrogen gas produced in the conversion zone. Steam is injected into the pyrolysis reaction zone to react with the hot particulate char contained therein to generate additional hydrogen gas to further hydrogenate the volatilized hydrocarbons resulting from the pyrolysis of the coal feed. Volatilized hydrocarbons are recovered from the pyrolysis product stream.

The solid carbonaceous materials from which values may be recovered in accordance with this invention include uintaite, tar sands, oil shale, the organic portion of solid waste, particularly coal, in which terms this invention is described, and the like, as well as mixtures thereof. All the various types of coal and coal-like substances, such as anthracite coal, bituminous coal, subbituminous coal, lignite and peat, can be used with this process.

Figure 1:
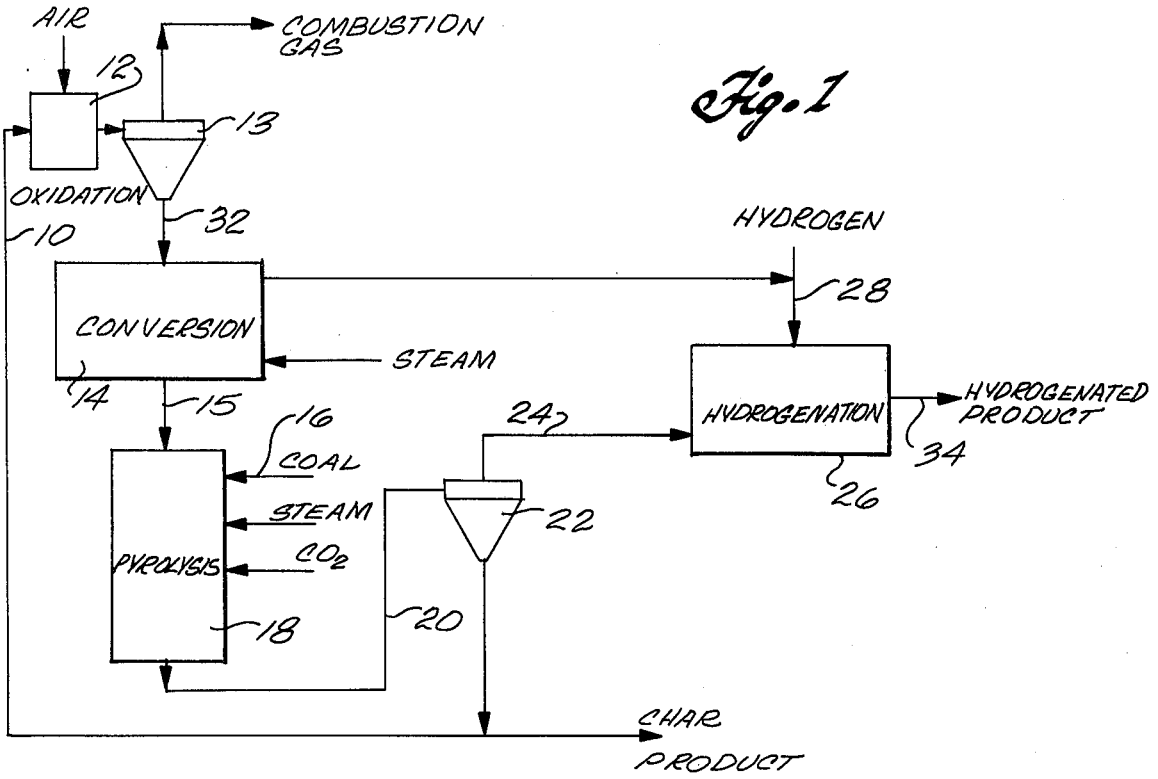

Referring to FIG. 1, which shows a process embodying features of this invention, a stream 10 containing char resulting from pyrolysis of coal is combined with a source of oxygen, such as air, in an oxidation zone 12 to produce hot char and a combustion gas. The combustion gas contains oxidation products of the char, such as carbon monoxide, carbon dioxide, sulfur dioxide, as well as nonreactive components of the source of oxygen, such as nitrogen, when air is the source of oxygen. In the oxidation zone, at least a portion of the char is oxidized. Oxidation of the char is an exothermic reaction and generates at least a portion of the heat required for pyrolysis of the coal.

The hot particulate char in the oxidation zone 12 is then separated from the combustion gas in a separation zone 13 such as one or more cyclone separation stages in series. Preferably, the oxidation zone is a cyclone oxidation-separation zone so that the char can both be heated and separated from the gaseous combustion products in a single unit with attendant savings in capital and operating costs.

The separated heated char particles 32 then flow into a conversion zone 14 in which they are reacted with steam to form hydrogen gas according to the following reactions:

$$C + H_2O \rightarrow CO + H_2 \quad (1)$$

$$CO + H_2O \rightarrow CO_2 + H_2 \quad (2)$$

The extent of char gasification to hydrogen and carbon monoxide is controlled by the amount of steam added to the conversion zone, and the temperature and pressure in the conversion zone. As more steam is added to the conversion zone, more hydrogen is generated.

According to the present invention, the char is gasified to produce hydrogen and carbon monoxide in the substantial absence of unpyrolyzed carbonaceous material. If hydrogen were allowed to form in the presence of unpyrolyzed carbonaceous material, yield of liquid hydrocarbons could be reduced. This is because hydrogen would be produced by reaction of steam with volatile components of the carbonaceous material feed. The result of this is condensible volatilized hydrocarbons which would normally be produced by pyrolysis of the carbonaceous material feed are consumed by reaction with steam even before the feed enters the pyrolysis reactor. This can have the consequence of substantially reducing liquid hydrocarbon yields from the process.

The gas produced in the conversion zone contains hydrogen, carbon monoxide, steam, and some carbon dioxide. This synthetic gas is commonly known as "syngas".

The temperature of the gas and hot particulate char stream 15 from the converter is varied by changing such process parameters as the temperature of the particulate char from the oxidation zone and the temperature of the steam injected into the char converter. The temperature of the effluent stream 15 from the char converter is controlled to provide the temperature desired for the pyrolysis of the coal. A discharge temperature of from about 100 to about 500° F. higher than the pyrolysis temperature is used.

Coal feed stream 16, syngas from the converter, and a particulate source of heat are combined in a coal pyrolysis reaction zone 18. At least a portion of the particulate source of heat includes char from the conversion zone. Before being fed to the pyrolysis reaction zone, the coal may be prepared for feed to the pyrolysis reaction zone by such operations as comminuting the coal to increase the surface area to volume ratio for efficient pyrolysis, by removal of magnetic particles, and by at least partially drying the coal to reduce the heat load in the pyrolysis reactor for vaporizing the water in the coal.

A carrier gas which is nondeleteriously reactive with respect to pyrolysis products may be used to convey the coal into the pyrolysis reaction zone. By a "nondeleteriously reactive" carrier or transport gas, there is meant a gas stream which is substantially free of free oxygen. Gases such as nitrogen or steam, and preferably gases resulting from the pyrolysis of the coal, may be used as the carrier gas. Also preferred is a hydrogen-enriched carrier gas, where the hydrogen can be a portion of the hydrogen generated in the char converter.

The transport gas for both the coal and the char can be the gas resulting from the pyrolysis of the coal, either before or after condensible hydrocarbons are recovered and compounds such as hydrogen sulfide are scrubbed from the gas. To obtain maximum utilization of the particulate heat source, the transport gas for the particulate heat source can have a temperature approaching the particulate heat source's temperature.

Generally, high solids content in the pyrolysis feed stream is desired to minimize equipment size and cost. However, preferably the pyrolysis reaction zone is operated under the conditions described in U.S. Pat. No. 3,736,233, issued to Sass et al and assigned to the assignee of this invention. According to the method of this patent, the pyrolysis feed stream preferably contains sufficient carrier gas that the feed stream has a low solids content ranging from about 0.1 to 10% by volume based on the total volume of the stream to provide turbulence for rapid heating of the coal and to dilute the coal particles and help prevent them from agglomerating, particularly when processing agglomerative coals.

In the pyrolysis reaction zone, the coal undergoes pyrolysis to yield char and volatilized hydrocarbons. The "char" is a combustible carbonaceous residue remaining after distillation of volatiles from coal. The "volatilized hydrocarbons" are the hydrocarbon containing gases produced by pyrolysis of coal. In general, these consist of condensible hydrocarbons which may be recovered by contacting the volatilized hydrocarbons with conventional condensation means and normally noncondensible gases, such as methane and other hydrocarbon gases, which are not recoverable by ordinary condensation means. A large portion of these volatilized hydrocarbons consists of heavy viscous tars having a high carbon-to-hydrogen molecular ratio. In addition, the volatilized hydrocarbons can be contaminated with organic sulfur compounds. In order to upgrade the value of the volatilized hydrocarbons and convert the organic sulfur compounds to hydrogen sulfide, which can then easily be separated from the hydrocarbons by scrubbing, hydrogenation of the volatilized hydrocarbons occurs in the pyrolysis reaction zone using the hydrogen gas produced in the char conversion zone. Vapor phase hydrogenation in the pyrolysis reaction zone also tends to reduce the viscosity and lower the average boiling point of the volatilized hydrocarbons, thereby allowing more efficient removal of solid contaminants from condensed volatilized hydrocarbons.

The method of this invention can be used with any coal pyrolysis reactor, such as a fluidized bed reactor as described in the paper, "Multi-Stage Fluidized-Bed Pyrolysis of Coal at the Project COED Pilot Plant", by Scotti et al, which was presented at the meeting of the American Institute of Chemical Engineers in Pittsburg, Pa. in June 1974, or a fast fluidized bed reactor as described in U.S. Pat. No. 3,855,070, issued to Squires. Preferably, the reactor is a flash pyrolysis reactor, such as the one described in U.S. Pat. No. 3,736,233, issued to Sass et al, for maximization of liquid yield.

The solids residence time in the pyrolysis reaction zone varies from about 0.01 to about 3600 seconds, depending upon which of these types of reactors is used. In order to obtain a high yield of condensible volatilized hydrocarbons, a flash pyrolysis reactor preferably is used. The solids residence time in a flash pyrolysis reactor preferably is less than about 5 seconds, and more preferably from about 0.1 to about 3 seconds.

As used herein, the term "solids residence time" refers to the average residence time of the carbonaceous material feed, the particulate source of heat, and the solids residue of pyrolysis of the carbonaceous material in a reactor.

Preferably, the char-to-coal weight ratio is from about 2 to about 20:1. The high ratio of char to coal helps prevent agglomerative coal particles from sticking together when an agglomerative coal or other agglomerative material is the carbonaceous material feed. The particulate char has a temperature consonant with the requirements of the pyrolysis zone, depending on the coal and carrier gas temperatures, and the mass ratios of the coal, char and carrier gas. At the above char-to-coal ratios, the temperature of the particulate char is about 100 to about 500° F. higher than the pyrolysis zone temperature.

The temperature in the pyrolysis reaction zone is dependent upon such process parameters as the temperature of the carrier gas, the temperature of the syngas, the temperature of the hot particulate char, and the mass ratios of the coal, carrier gas, and char. The temperature in the reaction zone is from about 600° F. to about 2000° F. It has been found that the type of product and total yield of product are highly dependent upon the temperature in the reaction zone and the solids residence time. As the temperature in the reaction zone increases, and/or the solids residence time increases, the volatilized hydrocarbons from the pyrolysis reaction contain increasing amounts of noncondensible hydrocarbons.

Preferably, the solids residence time in the pyrolysis reactor and the temperature of the coal in the pyrolysis reactor are controlled so that the yield of liquid hydrocarbon products from the pyrolysis reactor is at least 60% of Fischer assay. To obtain this yield with a residence time of 5 seconds, the maximum temperature in the pyrolysis reactor is about 1200° F. Likewise, at solid residence times of 4, 3, 2, 1, and 0.3 seconds, the maximum allowable temperature in the pyrolysis reactor is about 1400°, about 1500°, about 1600°, about 1700°, and about 1800° F., respectively.

As solids residence time in the pyrolysis reactor decreases, the minimum temperature required for devolatilization of the carbonaceous feed to obtain a yield of 60% Fischer assay increases. For example, for solid residence times of 5, 4, 3, 2, 1, and 0.3 seconds, the minimum temperature of the pyrolysis reaction zone is about 600°, about 700°, about 750°, about 900°, about 1000°, and about 1100° F., respectively, to obtain a yield of at least 60% Fischer assay.

Preferably, the particulate coal is heated to a temperature from about 900° F. to about 1400° F., and optimumly to about 1075° F., ro produce high yields of volatilized hydrocarbons containing a high percentage of valuable middle distillates when using a flash pyrolysis reactor having a solids residence time less than about 5 seconds. Middle distillates are the middle boiling hydrocarbons, i.e., C hydrocarbon to hydrocarbons having an end point of about 950° F. These hydrocarbons are useful for the production of gasoline, diesel fuel, heating fuel, and the like.

The maximum temperature in the pyrolysis reactor is limited by the temperature at which the inorganic portion of the source of heat or the coal softens with resultant fusion or slag formation. Since the particulate source of heat before introduction into the pyrolysis reactor is normally at a higher temperature than the pyrolysis reactor, its softening temperature is usually the limiting factor. A pyrolysis temperature of 2000° F. is about the maximum that can be obtained without slag formation.

The pyrolysis reaction zone is operated at pressures greater than ambient and up to about 10,000 psig. An increase in pressure increases the hydrogen partial pressure in the pyrolysis reaction zone and thus the severity of the hydrogenation of the volatilized hydrocarbons. However, as the pressure in the pyrolysis reaction zone increases, the capital costs and operating costs of the process increase. A preferred pressure range for the pyrolysis reaction zone for economic operation of the process is from about 450 to about 3500 psig.

Preferably, the conversion zone is operated at a pressure at least as high as the pressure in the coal pyrolysis zone so that high capacity compressors are not required to tranfer the effluent 15 from the char converter to the pyrolysis reaction zone.

Preferably, from about 0.1 to about 20 SCF (standard cubic feet) of carbon dioxide are introduced to the pyrolysis reaction zone per pound of char introduced to the pyrolysis reaction zone. It has been found that the presence of the carbon dioxide in the pyrolysis reaction zone increases the yield of the condensible hydrocarbons. This ratio of carbon dioxide to char can be obtained if the transfer gas introduced to the pyrolysis reaction zone contains from about 10 to about 90% carbon dioxide, where the charto-coal weight ratio is from about 2:1 to 20:1, and the feed stream has a solids content ranging from about 0.1 to 10% by volume based on the total volume of the stream. Preferably, the remainder of the feed stream consists of liquid or vaporized water, i.e., the transport gas used contains from about 10 to about 90% by volume carbon dioxide and from about 90 to about 10% by volume steam.

Pyrolysis reactors useful for combining hot particulate char and coal are shown in FIGS. 3–6. Using such apparatuses, the char and coal streams and hydrogen gas are intimately mixed under turbulent flow conditions to ensure good heat transfer from the hot particulate char to the coal feed stream and efficient pyrolysis and hydrogenation reactions. These apparatuses are particularly useful for agglomerative coals, because turbulent flow results in rapid heating of the coal through the tacky phase to prevent buildups of coal particles on the reactor walls.

Figure 3:
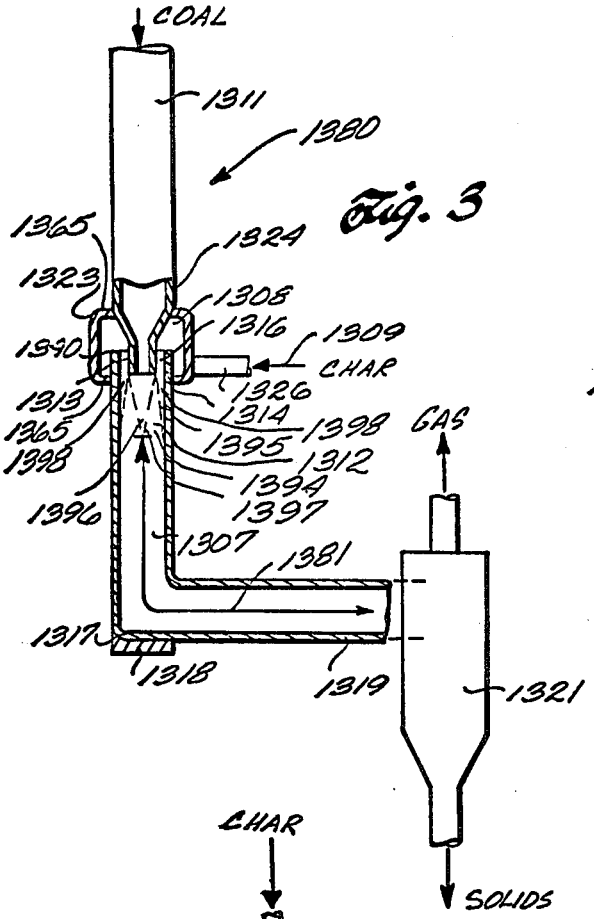

With reference to FIG. 3, the coal feed stream contained in a carrier gas enters a substantially vertically-oriented mixing section 1312 of a substantially vertically-oriented, descending flow pyrolysis reactor 1380, through a generally upright, annular first inlet 1311, terminating within the mixing section and constricted at its end 1313 to form a nozzle so that a fluid jet is formed thereby. Pyrolysis reactor 1380 is annular and has an upper end 1314, which is an open end of larger diameter than the nozzle 1313, thereby surrounding the nozzle and leaving an annular gap 1316 between the upper end 1314 of the reactor and the nozzle 1313. The reactor has an elbow 1317 in the middle which rests upon a support 1318. The lower end 1319 of the reactor terminates in a reactor product stream cyclone 1321 which separates the gaseous pyrolysis effluents from the solid pyrolysis effluents. An annular fluidizing chamber 1308 is formed by a tubular section 1323 with an annular rim 1365 connected to the first inlet wall 1324 directly above where the wall constricts to form the nozzle 1313 and the upper portion of the reactor. The chamber 1308 surrounds the nozzle 1313 and a portion of the upper end 1314 of the reactor.

A second annular inlet 1326 is generally horizontally connected to the annular fluidizing chamber 1308, therefore receiving ing a fluidized stream of char. The second inlet 1326 preferably is tangentially positioned with respect to the annular chamber wall to impart a swirl to the incoming stream. Preferably, the second annular inlet discharges char into the fluidizing chamber below the top edge 1340 of the reactor so that incoming char builds up in the fluidizing chamber 1308 and is restrained by the weir formed by the upper end 1314 of the reactor to form a solids seal. The char is maintained in a fluidized state in the chamber 1308 by a fluidizing or aerating gas which is substantially non-deleteriously reactive with respect to pyrolysis products fed through inlet 1326 into the chamber. The char in the chamber 1308 passes over the upper end of the overflow weir and through the opening 1316 between the weir and the nozzle into the mixing section of the reactor. The advantage of this weirlike configuration is that an essentially steady flow of fluidized char enters the mixing section because the mass of the char backed up behind the upper end 1314 of the reactor dampens minor fluctuations in the char flow.

The syngas can be introduced with the char to the reactor. Alternately, the syngas may be separated in a separation zone, such as a cyclone separator, from the char present in the conversion zone, and introduced as a separate stream into the pyrolysis reactor, or as at least a portion of the carrier gas for the coal.

In a preferred version of the invention, the syngas is formed by injecting steam directly to the annular chamber 1308. In the chamber, steam reacts with the char present according to reactions 1 and 2, above. Therefore, the annular chamber serves as the conversion zone. The advantage of this version of the process is that capital and operating costs associated with a separate char conversion zone are not incurred. Injection of steam directly into the annular chamber, to use the annular chamber as a char conversion zone, can be used with the reactor configurations of FIGS. 4 and 5, but not with the configuration of FIG. 6, because coal instead of char is introduced into the annular chamber 1308 of the reactor of FIG. 6, as described below.

In the mixing zone of the pyrolysis reactor, the carbonaceous material contained in the carrier gas is discharged from the nozzle as a fluid jet 1394, expanding towards the reactor wall at an angle of about 20° or less, as shown by dotted lines 1395 representing the periphery of the fluid jet. Once the particulate source of heat is inside the mixing section, it falls into the path of the fluid jet 1394 and is entrained thereby, yielding a resultant turbulent mixture of the particulate source of heat, coal feed, and the carrier gas. The jet has a free core region 1396 of coal, as delineated by the V-shaped dotted line 1397 in FIG. 3, extending considerably into the reactor. In the region 1398, between the reactor walls and the fluid jet 1394, there is unentrained particulate source of heat. The particulate source of heat along the periphery 1395 of the fluid jet preferably heats the carbonaceous material in the case of an agglomerative coal through the tacky state before the coal strikes the reactor walls. This mixing of the particulate source of heat with the solid carbonaceous material in the mixing zone initiates heat transfer from the particulate solid source of heat to the coal, causing pyrolysis to occur in a substantially vertically-oriented pyrolysis section 1307 of the pyrolysis reactor.

Figure 4:
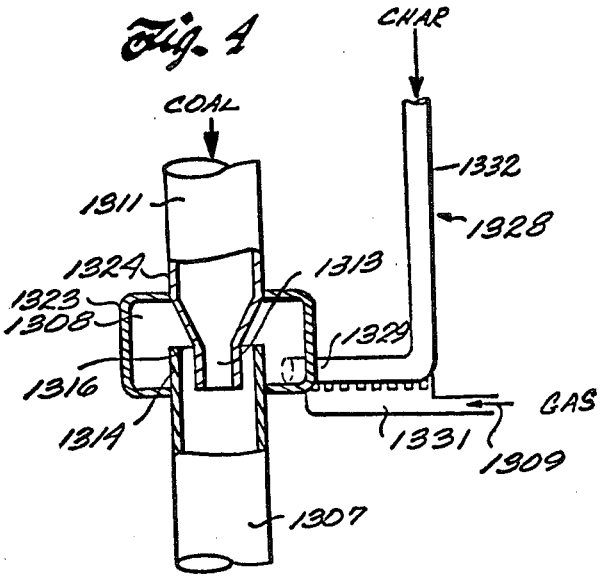

In FIG. 4, the apparatus is the same as that in FIG. 3, except for the second annular inlet 1328 which has a generally horizontal portion 1329 which is equipped with an air slide 1331. The air slide 1331 preferably operates on a transport gas stream 1309 resulting from the pyrolysis of the coal as a fluidizing gas stream. The inlet for the char also has a generally upright portion 1332 through which char is introduced and which communicates with the horizontal portion 1329. Char so vertically introduced is fluidized by the transport gas stream 1309 before its introduction into the fluidizing chamber 1308.

Figure 5:
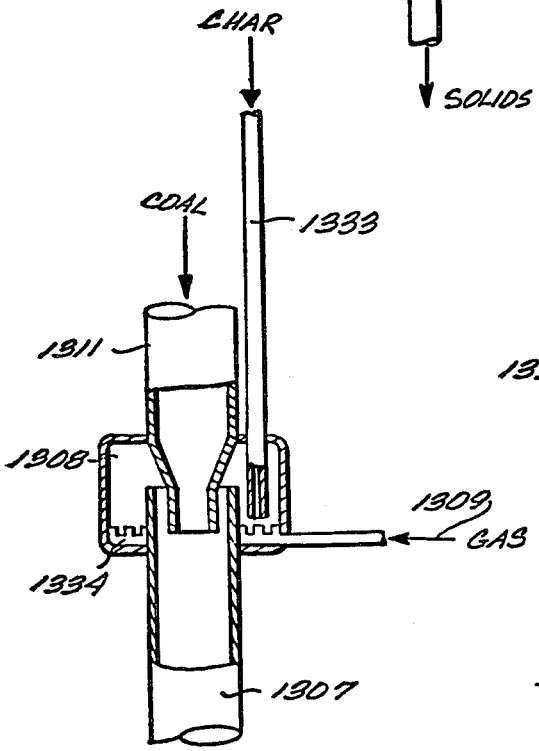

In FIG. 5, the apparatus is the same as in FIG. 3, except that the second annular inlet 1333 for introducing char comes generally vertically, instead of horizontally, into the fluidizing chamber 1308, and in that a porous bed or plate 1334 has been provided as the bottom of the chamber and has been connected to a souce of recycle or carrier gas 1309 adapted to operate thereon in order to fluidize said incoming char by injecting the char with gas.

Figure 6:
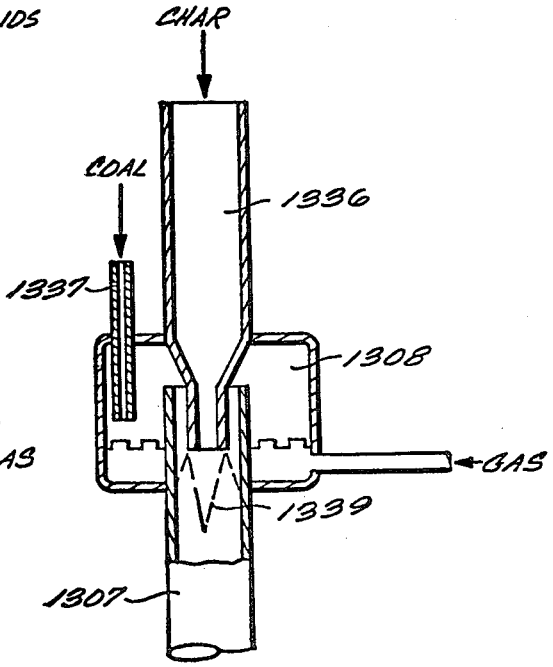

In FIG. 6, the apparatus is similar to that of FIG. 5, except that the char stream is introduced through the first inlet 1336, instead of the coal stream, the coal stream being introduced generally vertically instead to the fluidizing chamber via an upright second inlet 1337. This configuration is suitable only for nonagglomerative coals. The flow paths of the char and coal streams are the opposite of what they are in FIG. 5. The char stream in FIG. 6 is introduced rapidly enough to form a jet stream which acts upon the coal stream, as shown by the broken lines 1339, like in FIG. 5.

Similarly, the char may be introduced through the firs inlet, and a noncaking coal may be introduced through the second inlet in FIGS. 3 and 4.

An advantage of the apparatuses shown in FIGS. 4–6 is that the coal is heated rapidly in the case of agglomerative coals, so that the tacky or sticky phase is thereby gone through rapidly enough to prevent the coal particles from sticking to the reactor wall and plugging the reactor.

Preferably, in the apparatuses shown in FIGS. 3–6, the stream of particulate matter, either coal or char, which enters through the second inlet is maintained at a rate of flow less than turbulent, and the particulate stream entering via the first inlet is maintained under turbulent fow at a rate sufficiently high that the resulting mixture stream from the contacting of the two inlet streams is under turbulent flow. Turbulent flow results in intimate contact between the coal and char particles, thereby yielding rapid heating of the coal by the char, which improves yield. In the case of an agglomerative coal, buildups of tacky coal particles on the reactor walls are prevented due to rapid heating of the coal due to turbulent flow. As used herein, "turbulent" means the stream has a Reynolds flow index number greater than about 2000. The Reynolds number is based on the carrier gas at operating conditions. Laminar flow in the pyrolysis reactor tends to severely limit the rate of heat transfer within the pyrolysis zone. Process parameters, such as the nozzle diameter and mass flow rate of the particulate matter and its carrier gas, are varied to maintain the flow rate of the particulate stream entering the first inlet into the turbulent mixing region.

Preferably, the nozzle 1313 is protected from wear by being refractory-lined, or it may be lined with any conventional material, such as annealed stainless, inconel, and cast steels, and the like.

The end of the coal feed inlet preferably is cooled as by water when pyrolyzing an agglomerative coal, because the inlet can be heated above the point at which the coal becomes tacky due to heat transfer from the particulate source of heat surrounding the end of the solids feed inlet.

Although FIGS. 3–6 show a solids feed inlet having a nozzle at the end to achieve high inlet velocities into the mixing region, a nozzle at the end of the inlet is not required. Alternatively, the carbonaceous material and its carrier gas can be supplied at a sufficient velocity to the inlet so that the resultant mixture is under turbulent flow without need for a nozzle.

The effluent pyrolysis product stream 20 from the pyrolysis reaction zone contains char and a vapor mixture comprising volatilized hydrocarbons and the unreacted components of the syngas. The char is separated from the vapor mixture in a solid/vapor separator stage 22, such as one or more high efficiency cyclones in series. At least a portion of the separated char is recycled as the char stream 10 fed to the oxidation zone 12. The remainder of the char represents the net solid product obtained by the pyrolysis of the coal and is withdrawn as char product.

Initially, the system is started up by using char stream 10 fed to the oxidation zone. But after coal particles have had their volatiles removed, they are useful as the source of char particles required by the system. Char is produced in such excess that it is readily available for further processing to provide new materials which enhance the total economics of the process, such as fuel for use in a power plant or as a source of raw material for the chemical industry.

The vapors 24 from the solid/vapor separation zone 22 contain volatilized hydrocarbons, unreacted hydrogen, and nonhydro carbon gaseous products, such as carbon monoxide, carbon dioxide, hydrogen sulfide, and water. The condensible volatilized hydrocarbons can be separated and recovered by conventional separation and recovery means, such as venturi scrubbers, indirect heat exchangers, wash towers, and the like. The nonhydrocarbon gaseous products can be removed from the uncondensible hydrocarbons by means such as chemical scrubbing. The remaining uncondensed hydrocarbons can be sold as a product gas stream and can be utilized as the carrier gas for carrying the coal to the coal pyrolysis reaction zone. They may also be used as a carrier gas for transporting char particles into the oxidation zone.

As shown in FIG. 1, preferably the gaseous effluent 24 from the solid/vapor separation zone 22 is fed to a vapor hydrogenation zone 26 in which the volatilized hydrocarbons are further hydrogenated in the presence of a catalyst to further upgrade the value of the volatilized hydrocarbons.

The vapor hydrogenation zone preferably is operated at a high temperature with a high partial pressure of hydrogen because the degree of hydrogenation of the volatilized hydrocarbons increases with the severity of the hydrogenation. However, in order to avoid the cost of a high temperature compressor to transfer gas from the solid/vapor separation zone 22 to the vapor hydrogenator, the pressure in the vapor hydrogenator preferably is maintained at a pressure no greater than the pressure in the coal pyrolysis reaction zone, i.e., up to about 10,000 psig, and preferably from about 450 to 3500 psig.

A gas stream 28 containing hydrogen can be injected into the vapor hydrogenator to increase the concentration and thus the partial pressure of hydrogen in the vapor hydrogenation zone. This increases the amount of hydrogenation of the volatilized hydrocarbons. Hydrogen gas withdrawn from the char conversion zone, or a combined oxidation-conversion zone, may be used for this purpose.

A wide variety of catalysts can be used to catalyze the hydrogenation reaction. Among these are hydrocracking and hydrotreating catalysts, including compositions of cobalt, molybdenum, nickel, and tungsten, supported on silica-alumina or alumina bases.

Some thermal cracking of the higher molecular components of coal in the pyrolysis reaction zone and in the vapor hydrogenation zone occurs. This is desirable in that it tends to increase the overall yield of volatilized hydrocarbons. However, as noted above, at temperatures above about 1400° F. so much cracking occurs, the yield of the valuable middle distillates decreases. Therefore, preferably both the pyrolysis reaction zone and the vapor hydrogenation zone are maintained at a temperature less than about 1400° F.

Figure 2:
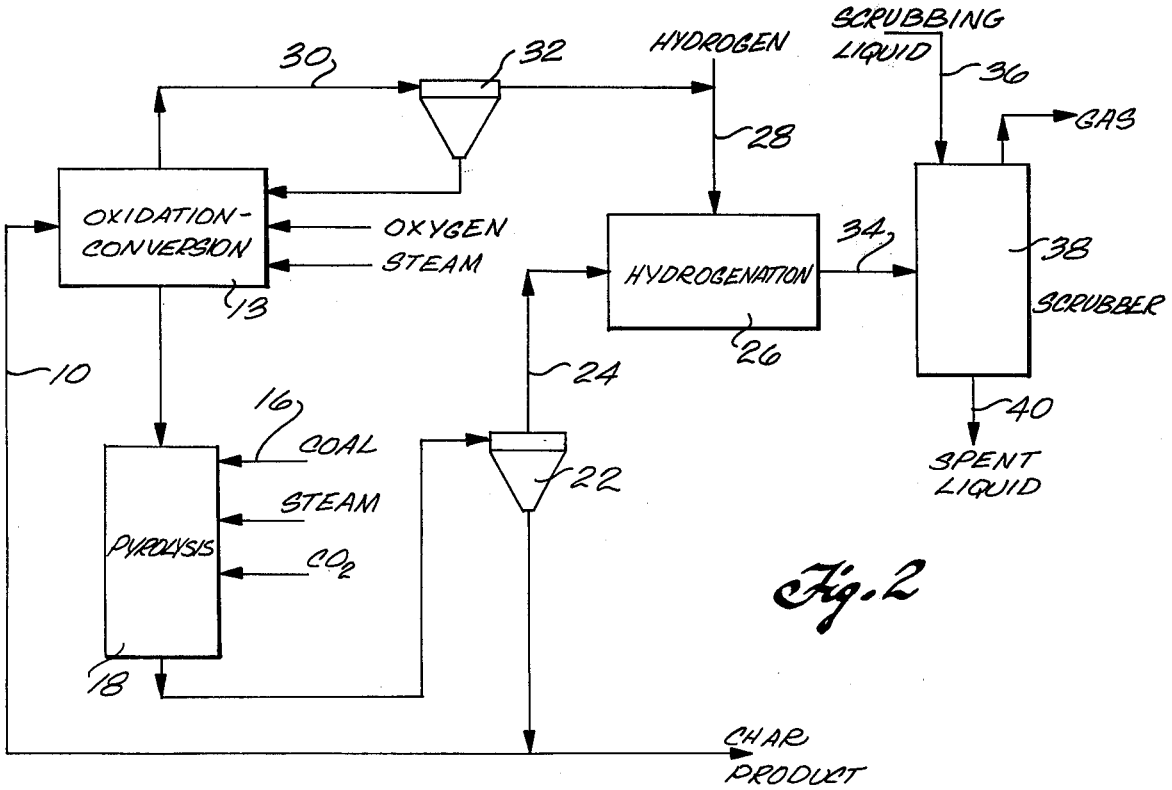

FIG. 2 shows an alternate scheme embodying features of this invention which differs from the process of FIG. 1 in two ways. First, the oxidation and conversion zones are combined in a single stage. Second, hydrogen sulfide in the effluent from the vapor hydrogenation zone is removed by scrubbing, preferably after cooling the effluent. Each or both of these variations can be used with the process of FIG. 1.

Referring to FIG. 2, the particulate char stream 10 resulting from the pyrolysis of the feed coal in a coal pyrolysis reaction zone 18, preferably substantially pure oxygen, and steam, are combined in the substantial absence of unpyrolyzed coal in a single oxidation-conversion zone 13 to yield hot particulate char and hydrogen gas. Advantages resulting from producing hot particulate char and syngas in a single stage include equipment and processing economies resulting from elimination of a reaction vessel and its associated piping.

Substantially pure oxygen is preferred for oxidizing the char in the embodiment shown in FIG. 2 so diluents present in a source of oxygen, such as the nitrogen present in air, are not added to the pyrolysis reactor and char converter in any substantial amounts. Therefore, at the same total pressure, the partial pressures of the reacting gases are higher.

As shown in FIG. 2, to obtain hydrogen for the hydrogenation zone 26, a stream 30 of syngas is withdrawn from the oxidation-conversion zone 13 and fed to a solid/gas separator, such as a cyclone 32, where any entrained char particles are separated from the gases in stream 30 and returned to the oxidation-conversion zone 13. The syngas is then fed via line 28 into the vapor hydrogenation zone 26 to increase the amount of hydrogenation of the volatilized hydrocarbons.

When the coal feed contains sulfur, at least a portion of the sulfur typically is hydrogenated to yield hydrogen sulfide in the pyrolysis reaction zone and also in the vapor hydrogenation zone when used. This is a desirable reaction, because it upgrades the char and hydrocarbon products of pyrolysis by reducing their sulfur content, thereby increasing their value as premium, non-polluting fuels.

As shown in FIG. 2, the hydrogen sulfide may be removed from the volatilized hydrocarbons by contacting the gaseous effluent 34 from the vapor hydrogenation zone 26 with an absorption solution stream 36 in which hydrogen sulfide gas is soluble in a scrubbing stage 38. Typical of the compounds which can be contained in the absorption solution which absorb hydrogen sulfide are the amines. A stream 40 of spent absorption solution can be degassed to recover the hydrogen sulfide which may then be sent to a Claus unit for recovery of sulfur.

EXAMPLES 1–8

Tests were conducted to demonstrate that introduction of steam and/or carbon dioxide into a flash pyrolysis reactor increases the yield of liquid products.

Figure 7:
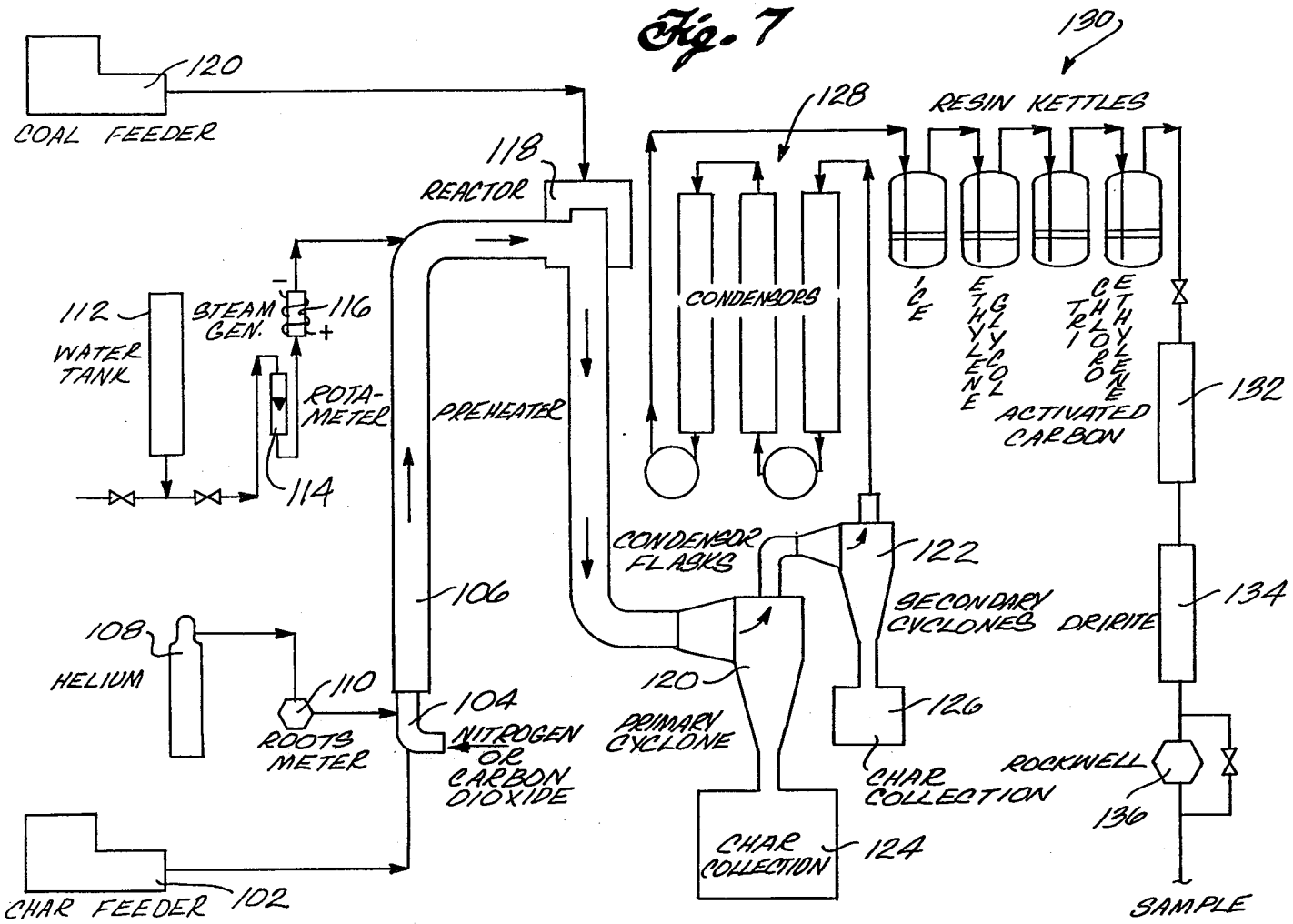

With reference to FIG. 7, a bench scale unit includes a char feeder 102 for feeding char to a transport line 104 through which it is carried by a transport gas containing nitrogen or carbon dioxide to a preheater 106. Helium from a tank 108 can be metered by a Roots Meter 110 into the transport line 104. Facilities are provided for introducing steam to the preheater. These facilities include a water tank 112 supplying water, a rotometer 114 for monitoring the flow of water introduced to the preheater, and an electrical steam generator 116. From the preheater, introduced solids are carried by the transport gas to a pyrolysis reactor 118, to which coal can be fed by a coal feeder 120. Solids in the pyrolysis reactor are separated from vapors present in the pyrolysis reactor in a primary 120 and a secondary 122 cyclones in series. Solids separated by the primary and secondary cyclones are collected in a first char collection bin 124 and a second char collection bin 126, respectively. Hot vapors passing from the secondary cyclones are cooled in a series of condensers 128 and knock-out pots 130, pass through an electrostatic precipitator (not shown), an activated carbon column 132, and a drierite column 134. The cleaned and dried gases are then metered by a Rockwell Dry Gas Meter 136 and sampled.

Eight tests were run. For Example 1, electrical heating was used, and for Example 2, alumina was used with a solids ratio of alumina particles to coal feed of 5:1. For Examples 3–8, char was used at varying solids ratios as indicated in Table 1. The preheater was maintained at a temperature of 1225± 50° F., and the solids loading in the pyrolysis reactor was maintained at about 1 pound per SCF of carrier gas for each test. The heating mode, solids ratio, transport gas composition, and liquid yield are presented in Table 1 for each test.

Comparison of the results of Example 3 with the results of Examples 1 and 2 indicate that the use of char can decrease the liquid yield obtained by pyrolysis of subbituminous coal as compared to heating with electrical heating or alumina particles. It is believed that this occurs by the char acting as a catalyst for cracking of volatilized hydrocarbons. However, as shown by comparison of Examples 3, 4, and 5, introducing increasing amounts of steam to the reactor can raise the liquid yield to a level comparable to the yield obtained in the absence of char. Furthermore, as shown by Example 7, introducing carbon dioxide to the pyrolysis reactor as part of the transport gas gives a higher liquid yield than the liquid yield obtained by using an inert transport gas.

Based on these test results, along with other tests done, it was concluded that using steam alone as the transport gas is most effective for maximization of liquid yield when using hot char as the heat source for pyrolysis of coal, steam and carbon dixoide in combination are next effective, carbon dioxide by itself is next effective in increasing liquid yield, and an inert transport gas gives the lowest liquid yield.

Table 1

| | | Tar Yield from Flash Pyrolysis of Subbituminous Coal/Carrier Gas | | | | |
|---|---|---|---|---|---|---|
| Example No. | Heating Mode | Solids Ratio | Transport Gas (Volume %) $N_2$ + He | $CO_2$ | $H_2O$ | Liquid Yield (% Fischer Assay) |
| 1 | Electrical | 0 | 100 | — | — | 154 |
| 2 | Alumina | 5 | 100 | — | — | 155 |
| 3 | Char | 3.3 | 100 | — | — | 106 |
| 4 | Char | 3.3 | 90 | 0 | 10 | 140 |
| 5 | Char | 6.7 | 78 | 0 | 22 | 158 |
| 6 | Char | 3.3 | 0 | 58 | 42 | 151 |
| 7 | Char | 3.3 | 2 | 98 | 0 | 145 |
| 8 | Char | 18 | 2 | 88 | 10 | 172 |

The method of this invention has many advantages compared to the prior art processes for pyrolyzing coal and hydrogenating the hydrocarbon products of the coal. For example, direct vapor hydrogenation demonstrates both higher reactivity and higher selectivity, indicating more hydrogenation and more efficient use of hydrogen, than hydrogenation of collected liquid hydrocarbons.

Compared to processes where the volatilized hydrocarbons are condensed, collected, reheated, and then hydrogenated, lower capital and operating costs are realized because the steps of condensation, collection, and reheating are eliminated. Another advantage of this novel process is that when the volatalized hydrocarbons are condensed, they have a relatively low viscosity because they have been hydrogenated and are therefore easier to collect and transport. By using the same particulate source of heat in the pyrolysis reaction zone and source of syngas, lower capital and operating costs are realized, because only one char loop is required.

Although this process has been described in terms of preferred versions, other embodiments are possible. These include using a single cyclone reactor for the pyrolysis reaction zone and the solid/vapor separation zone, thereby saving the cost of a separate cyclone for the solid/vapor separation operation. In an alternate version, some of the hot particulate char produced in the oxidation zone can be fed directly to the pyrolysis reaction zone, thereby bypassing the char conversion zone. In this alternate version, not all of the hot particulate char is fed to the char conversion zone—just enough char to produce the required amount of syngas.

Because of variations of the preferred embodiments such as these, the spirit and scope of the appended claims should not necessarily be limited to the description of the preferred versions described herein.

What is claimed is:

1. A continuous process for recovery of liquid hydrocarbon values from a solid carbonaceous material feed comprising the steps of:

(a) oxidizing particulate carbon containing residue resulting from pyrolysis of the carbonaceous material in an oxidation zone in the presence of a source of oxygen to produce hot particulate carbon containing residue and a combustion gas;

(b) passing carbon containing residue and combustion gas from the oxidation zone to a separation zone and separating in the separation zone hot particulate carbon containing residue from the combustion gas;

(c) forming hydrogen gas in a conversion zone by reacting at least a portion of the separated hot particulate carbon containing residue with steam in the substantial absence of unpyrolyzed solid carbonaceous material;

(d) simultaneously pyrolyzing the carbonaceous material and hydrogenating pyrolysis products of the carbonaceous material by combining hydrogen gas from the conversion zone, the carbonaceous material feed, and a particulate source of heat including carbon containing residue from the conversion zone in a flash pyrolysis reaction zone having a temperature of from about 600° to about 2000° F., a pressure from ambient up to about 10,000 psig, and a solids residence time less than about 5 seconds to yield a pyrolysis product stream containing as solids, a particulate carbon containing residue of pyrolysis and particulate source of heat, and a vapor mixture comprising volatilized hydrocarbons including middle distillates and unreacted hydrogen gas;

(e) separating vapor mixture from carbon containing residue;

(f) hydrogenating volatilized hydrocarbons in separated vapor mixture with hydrogen gas of the vapor mixture in the presence of catalyst in a vapor hydrogenation zone; and (g) condensing hydrocarbons including middle distillates from the hydrogenated vapor mixture.

2. A process as claimed in claim 1 in which the temperature of the pyrolysis reaction zone is from about 600° to about 1400° F.

3. A process as claimed in claim 1 in which the temperature of the pyrolysis reaction zone is from about 900° to about 1400° F.

4. A process as claimed in claim 1 in which the solids residence time in the pyrolysis reaction zone is from about 0.5 to about 3 seconds.

5. A process as claimed in claim 1 including the step of introducing steam to the pyrolysis reaction zone for reacting with carbon containing residue therein to generate additional hydrogen gas to further hydrogenate the volatilized hydrocarbons resulting from the pyrolysis of the carbonaceous material feed.

6. A process as claimed in claim 1 including the step of introducing a source of hydrogen gas to the vapor hydrogenation zone in addition to the unreacted hydrogen in the vapor mixture.

7. A process as claimed in claim 6 in which hydrogen gas from the conversion zone is introduced to the vapor hydrogenation zone.

8. A process as claimed in claim 1 in which the carbonaceous material feed contains sulfur which reacts with hydrogen gas in the pyrolysis reaction zone to yield hydrogen sulfide gas, and comprising the additional step of removing the hydrogen sulfide from the volatilized hydrocarbons hydrogenated in the vapor hydrogenation zone by contacting a stream containing the volatilized hydrocarbons and hydrogen sulfide gas with an absorption solution in which hydrogen sulfide gas is soluble.

9. A continuous process for recovery of liquid hydrogen values from a coal feed comprising the steps of:

(a) at least partially oxidizing particulate char resulting from pyrolysis of the coal feed in an oxidation zone in the presence of a source of oxygen and in the substantial absence of coal to produce hot particulate char and gaseous combustion products of the char;

(b) separating the hot particulate char from the gaseous combustion products of the char;

(c) forming hydrogen gas in a char conversion zone by reacting at least a portion of the separated hot particulate char with steam;

(d) simultaneously pyrolyzing the coal feed and hydrogenating pyrolysis products of the coal by combining hydrogen gas from the char conversion zone, the coal feed and a particulate source of heat including hot particulate char from the char conversion zone in a flash pyrolysis reaction zone having an operating temperature of from about 600° to about 1400° F., a pressure of from ambient up to about 10,000 psig, and a coal residence time of less than about 5 seconds to yield a pyrolysis product stream containing particulate char and a vapor mixture comprising unreacted hydrogen gas and hydrogenated volatilized hydrocarbons including middle distillates;

(e) introducing steam to the pyrolysis reaction zone for reacting with the hot particulate char therein to generate additional hydrogen gas to further hydrogenate the volatilized hydrocarbons resulting from the pyrolysis of the coal feed;

(f) separating vapor mixture from the char;

(g) catalytically hydrogenating volatilized hydrocarbons in the separated vapor mixture with unreacted hydrogen gas of the vapor mixture in a vapor hydrogenation zone; and (h) condensing hydrocarbons including middle distillates from the hydrogenated vapor mixture.

10. A process as claimed in claim 9 in which the temperature of the pyrolysis reaction zone is from about 900° to about 1400° F.

11. A process as claimed in claim 9 in which the pressure in the pyrolysis reaction zone is from about 450 to about 3500 psig.

12. A process as claimed in claim 9 including the step of introducing a source of hydrogen gas to the vapor hydrogenation zone in addition to the unreacted hydrogen in the vapor mixture.

13. A process as claimed in claim 12 in which hydrogen gas from the conversion zone is introduced to the vapor hydrogenation zone.

14. A process as claimed in claim 9 in which the solids residence time in the pyrolysis reaction zone is from about 0.5 to about 3 seconds.

15. A continuous process for recovery of liquid hydrocarbon values from a particulate agglomerative coal feed comprising the steps of:

(a) oxidizing particulate char resulting from pyrolysis of the particulate agglomerative coal feed in an oxidation zone in the presence of a source of oxygen and in the substantial absence of coal to produce hot particulate char and a combustion gas;

(b) passing the char and combustion gas from the oxidation zone to a separation zone and separating in the separation zone hot particulate char from the combustion gas;

(c) forming hydrogen gas in a conversion zone by reacting at least a portion of the separated hot particulate char with steam;

(d) subjecting the particulate agglomerative coal feed to flash pyrolysis by continuously;

(i) transporting the particulate agglomerative coal feed contained in a carrier gas which is substantially nondeleteriously reactive with respect to the products of pyrolysis of the particulate agglomerative coal feed to a solids feed inlet of a substantially vertically oriented, descending flow, substantially vertically oriented pyrolysis transport flash pyrolysis reactor having a substantially vertically oriented pyrolysis zone operated at a pyrolysis temperature from about 600° to about 2000° F., a pressure of from about 450 to about 3500 psig, and a solids residence time of less than about 5 seconds;

(ii) feeding a particulate source of heat including hot particulate char from the oxidation zone to a substantially vertically oriented chamber surrounding the upper portion of the pyrolysis reactor, the inner peripheral wall of said chamber forming an overflow weir to a vertically oriented mixing section of the vertically oriented descending flow, transport flash pyrolysis reactor, the particulate heat source in said chamber being maintained in a fluidized state by the flow therewith of an aerating gas substantially nondeleteriously reactive with respect to the products of pyrolysis of the particulate agglomerative coal feed;

(iii) discharging the particulate source of heat over said weir and downwardly into said mixing section at a rate sufficient to maintain said pyrolysis zone at the pyrolysis temperature;

(iv) injecting the particulate agglomerative coal feed and carrier gas from the solids feed inlet into the mixing section to form a resultant turbulent mixture of the particulate source of heat, the particulate agglomerative coal feed and the carrier gas;

(v) passing the resulting turbulent mixture downwardly from said mixing section to the pyrolysis zone of said pyrolysis reactor to pyrolyze the particulate agglomerative coal feed in the presence of hydrogen gas from the conversion zone while simultaneously hydrogenating pyrolysis products of the particulate agglomerative coal feed to yield a pyrolysis product stream containing as solids the particulate source of heat and a carbon containing solid residue of pyrolysis of the particulate agglomerative coal feed, and a vapor mixture of carrier gas and pyrolytic vapors comprising unreacted hydrogen gas and hydrogenated volatilized hydrocarbons including middle distillates and unreacted hydrogen gas; separating vapor mixture from the char; and (f) hydrogenating volatilized hydrocarbons in separated vapor mixture with hydrogen gas of the vapor mixture in the presence of a catalyst in a vapor hydrogenation zone; and (e) condensing hydrocarbons including middle distillates from the vapor mixture.

16. The method of claim 15 including the step of injecting steam into the pyrolysis reaction zone to react with the hot particulate char therein to generate additional hydrogen gas to further hydrogenate the volatilized hydrocarbons resulting from the pyrolysis of the coal feed.

17. The method of claim 16 including the step of introducing carbon dioxide to the pyrolysis reaction zone.

18. The method of claim 15 including the step of introducing carbon dioxide to the pyrolysis reaction zone.

19. The method of claim 15 in which the temperature of the pyrolysis reaction zone is from about 600° to about 1400° F.

20. The method of claim 15 including the step of introducing a source of hydrogen gas to the vapor hydrogenation zone in addition to the unreacted hydrogen in the vapor mixture.

21. The method of claim 20 in which hydrogen gas from the conversion zone is introduced to the vapor hydrogenation zone.

22. The method of claim 15 in which the temperature of the pyrolysis reaction zone is from about 900° to about 1400° F.

23. A continuous process for recovery of liquid hydrocarbon values from a solid carbonaceous material feed comprising the steps of:

(a) oxidizing particulate carbon containing residue resulting from pyrolysis of the carbonaceous material in an oxidation zone in the presence of a source of oxygen to produce hot particulate carbon containing residue and a combustion gas;

(b) passing the carbon containing residue and combustion gas from the oxidation zone to a separation zone and separating in the separation zone hot particulate carbon containing residue from the combustion gas;

(c) forming hydrogen gas in a conversion zone by reacting at least a portion of the separated hot particulate carbon containing residue with steam in the substantial absence of unpyrolyzed solid carbonaceous material;

(d) simultaneously pyrolyzing the carbonaceous material and hydrogenating pyrolysis products of the carbonaceous material by combining hydrogen gas from the conversion zone, the carbonaceous material feed, and a particulate source of heat including carbon containing residue from the conversion zone in a flash pyrolysis reaction zone having a temperature of from about 600° to about 2000° F., a pressure from ambient up to about 10,000 psig, and a solids residence time less than about 5 seconds to yield a pyrolysis product stream containing as solids, a particulate carbon containing residue of pyrolysis and particulate source of heat, and a vapor mixture comprising unreacted hydrogen gas and volatilized hydrocarbons including middle distillates;

(e) separating vapor mixture from the solids;

(f) catalytically hydrogenating volatilized hydrocarbons in separated vapor mixture with unreacted hydrogen gas of the vapor mixture in a vapor hydrogenation zone; and (g) condensing hydrocarbons including middle distillates from the hydrogenated vapor mixture.

24. A process as claimed in claim 23 in which the temperature of the pyrolysis reaction zone is from about 600° to about 1400° F.

25. A process as claimed in claim 23 in which the temperature of the pyrolysis reaction zone is from about 900° to about 1400° F.

26. A process as claimed in claim 23 in which the solids residence time in the pyrolysis reaction zone is from about 0.5 to about 3 seconds.

27. A process as claimed in claim 23 including the step of introducing a source of hydrogen gas to the vapor hydrogenation zone in addition to the unreacted hydrogen in the vapor mixture.

28. A process as claimed in claim 27 in which hydrogen gas from the conversion zone is introduced to the vapor hydrogenation zone.

29. A process as claimed in claim 23 in which the carbonaceous material feed contains sulfur which reacts with hydrogen gas in the pyrolysis reaction zone to yield hydrogen sulfide gas, and comprising the additional step of removing the hydrogen sulfide from the volatilized hydrocarbons hydrogenated in the vapor hydrogenation zone by contacting a stream containing the volatilized hydrocarbons and hydrogen sulfide gas with an absorption solution in which hydrogen sulfide gas is soluble.

30. A continuous process for recovery of liquid hydrocarbon values from carbonaceous material feed comprising the steps of:

(a) combining particulate carbon containing residue resulting from pyrolysis of the carbonaceous material feed, steam, and a source of oxygen in an oxidation-conversion zone in the substantial absence of unpyrolyzed carbonaceous material to produce hot particulate carbon containing residue and a combustion gas by at least partial oxidation of carbon in the carbon containing residue while simultaneously producing hydrogen gas by reaction of steam which is introduced into the oxidation-conversion zone with carbon in the carbon containing residue;

(b) simultaneously pyrolyzing the carbonaceous material and hydrogenating pyrolysis products of the carbonaceous material by combining the carbonaceous material feed, hydrogen gas from the oxidation-conversion zone, and a particulate source of heat including carbon containing residue from the oxidation-conversion zone in a flash pyrolysis reaction zone having a temperature from about 600° to about 2000° F., a pressure from ambient up to about 10,000 psig, and a solids residence time of less than about 5 seconds to yield a pyrolysis product stream containing as solids a particulate carbon containing residue of pyrolysis and particulate source of heat, and a vapor mixture comprising volatilized hydrocarbons including middle distillates; and (c) condensing hydrocarbons including middle distillates from the vapor mixture.

31. A process as claimed in claim 30 in which the source of oxygen is substantially pure oxygen.

32. A process as claimed in claim 30 in which the temperature of the pyrolysis reaction zone is from about 600° to about 1400° F.

33. A process as claimed in claim 30 in which the temperature of the pyrolysis reaction zone is from about 900° to about 1400° F.

34. A process as claimed in claim 30 in which the solids residence time in the pyrolysis reaction zone is from about 0.5 to about 3 seconds.

35. A process as claimed in claim 30 in which the vapor mixture comprises unreacted hydrogen gas and including the steps of:

separating vapor mixture from carbon containing residue; and catalytically hydrogenating volatilized hydrocarbons in the separated vapor mixture with hydrogen gas of the vapor mixture in the presence of catalyst in a vapor hydrogenation zone.

36. A process as claimed in claim 35 including the step of introducing a source of hydrogen gas to the vapor hydrogenation zone in addition to the unreacted hydrogen in the vapor mixture.

37. A process as claimed in claim 36 in which hydrogen gas from the oxidation-conversion zone is introduced to the vapor hydrogenation zone.

38. A process as claimed in claim 35 in which the carbonaceous material feed contains sulfur which reacts with hydrogen gas in the pyrolysis reaction zone to yield hydrogen sulfide gas, and comprising the additional step of removing the hydrogen sulfide from the volatilized hydrocarbons hydrogenated in the vapor hydrogenation zone by contacting a stream containing the volatilized hydrocarbons and hydrogen sulfide gas with an absorption solution in which hydrogen sulfide gas is soluble.

39. A process as claimed in claim 36 in which the carbonaceous material feed contains sulfur which reacts with hydrogen gas in the pyrolysis reaction zone to yield hydrogen sulfide gas, and comprising the additional step of removing the hydrogen sulfide from the volatilized hydrocarbons by contacting a stream containing the volatilized hydrocarbons and hydrogen sulfide gas with an absorption solution in which hydrogen sulfide gas is soluble.

40. The method of claim 30 including the step of introducing steam to the pyrolysis reaction zone to react with carbon containing residue therein to generate additional hydrogen gas to further hydrogenate volatilized hydrocarbons resulting from pyrolysis of carbonaceous material feed.

41. A continuous process for recovery of liquid hydrocarbon values from a coal feed comprising the steps of:

(a) combining particulate char resulting from pyrolysis of the coal feed, steam, and a source of oxygen in an oxidation-conversion zone in the substantial absence of unpyrolyzed coal to produce hot particulate char and a combustion gas by at least partial oxidation of carbon in the particulate char while simultaneously producing hydrogen gas by reaction of steam which is introduced into the oxidation-conversion zone with carbon in the particulate char;

(b) simultaneously pyrolyzing the coal feed and hydrogenating pyrolysis products of the coal feed by combining the coal feed, hydrogen gas from the oxidation-conversion zone, and a particulate source of heat including hot particulate char from the oxidation-conversion zone in a flash pyrolysis reaction zone having a temperature from about 600° to about 1400° F., a pressure from ambient up to about 10,000 psig, and a solids residence time of less than about 5 seconds to yield a pyrolysis product stream containing particulate char and a vapor mixture comprising unreacted hydrogen gas and volatilized hydrocarbons including middle distillates;

(c) introducing steam to the pyrolysis reaction zone to react with particulate char therein to generate additional hydrogen gas to further hydrogenate the volatilized hydrocarbons resulting from the pyrolysis of the coal feed;

(d) separating vapor mixture from the char;

(e) catalytically hydrogenating volatilized hydrocarbons in separated vapor mixture with unreacted hydrogen gas of the vapor mixture in a vapor hydrogenation zone; and (f) condensing hydrocarbons including middle distillates from the hydrogenating vapor mixture.

42. A process as claimed in claim 41 in which the source of oxygen is substantially pure oxygen.

43. A process as claimed in claim 41 in which the temperature of the pyrolysis reaction zone is from about 900° to about 1400° F.

44. A process as claimed in claim 41 in which the solids residence time in the pyrolysis reaction zone is from about 0.5 to about 3 seconds.

45. A process as claimed in claim 41 including the step of introducing a source of hydrogen gas to the vapor hydrogenation zone in addition to the unreacted hydrogen in the vapor mixture.

46. A process as claimed in claim 41 in which hydrogen gas from the oxidation-conversion zone is introduced to the vapor hydrogenation zone.

47. A process as claimed in claim 45 in which the carbonaceous material feed contains sulfur which reacts with hydrogen gas in the pyrolysis reaction zone to yield hydrogen sulfide gas, and comprising the additional step of removing the hydrogen sulfide from the volatilized hydrocarbons hydrogenated in the vapor hydrogenation zone by contacting a stream containing the volatilized hydrocarbons and hydrogen sulfide gas with an absorption solution in which hydrogen sulfide gas is soluble.

48. A process as claimed in claim 41 in which the carbonaceous material feed contains sulfur which reacts with hydrogen gas in the pyrolysis reaction zone to yield hydrogen sulfide gas, and comprising the additional step of removing the hydrogen sulfide from the volatilized hydrocarbons by contacting a stream containing the volatilized hydrocarbons and hydrogen sulfide gas with an absorption solution in which hydrogen sulfide gas is soluble.

49. A continuous process for recovery of liquid hydrocarbon values from particulate agglomerative coal feed comprising the steps of:

(a) combining particulate char resulting from pyrolysis of the particulate agglomerative coal feed, steam, and a source of oxygen in an oxidation-conversion zone in the substantial absence of unpyrolyzed coal feed to produce hot particulate char and a combustion gas by at least partial oxidation of carbon in the char while simultaneously producing hydrogen gas by reaction of the steam with carbon in the char;

(b) subjecting the particulate agglomerative coal feed to flash pyrolysis by continuously:

(i) transporting the particulate agglomerative coal feed contained in a carrier gas which is substantially nondeleteriously reactive with respect to the products of pyrolysis of the particulate agglomerative coal feed to a solids feed inlet of a substantially vertically oriented, descending flow, transport flash pyrolysis reactor having a substantially vertically oriented pyrolysis zone operated at a pyrolysis temperature from about 600° to about 2000° F., a pressure of from about 450 to about 3500 psig, and a solids residence time of less than about 3 seconds;

(ii) feeding a particulate source of heat including hot particulate char from the oxidation zone to a substantially vertically oriented chamber surrounding the upper portion of the pyrolysis reactor, the inner peripheral wall of said chamber forming an overflow weir to a vertically oriented mixing section of the vertically oriented, descending flow, transport flash pyrolysis reactor, the particulate heat source in said chamber being maintained in a fluidized state by the flow therewith of an aerating gas substantially nondeleteriously reactive with respect to the products of pyrolysis of the particulate agglomerative coal feed;

(iii) discharging the particulate source of heat over said weir and downwardly into said mixing section at a rate sufficient to maintain said pyrolysis zone at the pyrolysis temperature;

(iv) injecting the particulate agglomerative coal feed and carrier gas from the solids feed inlet into the mixing section to form a resultant turbulent mixture of the particulate source of heat, the particulate agglomerative coal feed and the carrier gas;

(v) passing the resultant turbulent mixture downwardly from said mixing section to the pyrolysis zone of said pyrolysis reactor to pyrolyze the particulate agglomerative coal feed in the presence of hydrogen gas from the conversion zone while simultaneously hydrogenating pyrolysis products of the particulate agglomerative coal feed to yield a pyrolysis product stream containing as solids the particulate source of heat and a carbon containing solid residue of pyrolysis of the particulate agglomerative coal feed, and a vapor mixture of carrier gas and pyrolytic vapors comprising hydrogenated volatilized hydrocarbons including middle distillates; and (e) condensing hydrocarbons including middle distillates from the vapor mixture.

50. A process as claimed in claim 49 including the step of injecting steam to the pyrolysis reaction zone to react with the hot particulate char therein to generate additional hydrogen gas to further hydrogenate the volatilized hydrocarbons resulting from the pyrolysis of the coal feed.

51. A process as claimed in claim 49 in which the temperature of the pyrolysis reaction zone is from about 600 to about 1400° F.

52. The method of claim 49 including the steps of:

separating vapor mixture from the char; and hydrogenating volatilized hydrocarbons in separated vapor mixture with hydrogen gas of the vapor mixture in the presence of a catalyst in a vapor hydrogenation zone.

53. A process as claimed in claim 52 including the step of introducing a source of hydrogen gas into the vapor hydrogenation zone in addition to the unreacted hydrogen in the vapor mixture.

54. A process as claimed in claim 53 in which hydrogen gas from the conversion zone is introduced to the vapor hydrogenation zone.

55. A process as claimed in claim 49 in which the temperature of the pyrolysis reaction zone is from about 900° to about 1400° F.

56. A continuous process for recovery of liquid hydrocarbon values from carbonaceous material feed comprising the steps of:

(a) combining particulate carbon containing residue resulting from pyrolysis of the carbonaceous material feed, steam, and a source of oxygen in an oxidation-conversion zone in the substantial absence of unpyrolyzed carbonaceous material to produce hot particulate carbon containing residue and a combustion gas by at least partial oxidation of carbon in the carbon containing residue while simultaneously producing hydrogen gas by reaction of the steam with carbon in the carbon containing residue;

(b) simultaneously pyrolyzing the carbonaceous material feed and hydrogenating pyrolysis products of the carbonaceous material feed by combining the carbonaceous material feed, hydrogen gas from the oxidation-conversion zone, and a particulate source of heat including carbon containing residue from the oxidation conversion zone in a flash pyrolysis reaction zone having a temperature from about 600° to about 2000° F., a pressure from ambient up to about 10,000 psig, and a solids residence time of less than about 5 seconds to yield a pyrolysis product stream containing as solids a particulate carbon containing residue of pyrolysis of the carbonaceous material feed and particulate source of heat, and a vapor mixture comprising unreacted hydrogen gas and volatilized hydrocarbons including middle distillates;

(c) separating vapor mixture from the solids;

(d) catalytically hydrogenating volatilized hydrocarbons in separated vapor mixture with unreacted hydrogen gas of the vapor mixture in a vapor hydrogenation zone; and (e) condensing hydrocarbons including middle distillates from the hydrogenated vapor mixture.

57. A process as claimed in claim 56 in which the temperature of the pyrolysis reaction zone is from about 600° to about 1400° F.

58. A process as claimed in claim 56 in which the temperature of the pyrolysis reaction zone is from about 900° to about 1400° F.

59. A process as claimed in claim 56 in which the solids residence time in the pyrolysis reaction zone is from about 0.5 to about 3 seconds.

60. A process as claimed in claim 56 including the step of introducing a source of hydrogen gas to the vapor hydrogenation zone in addition to the unreacted hydrogen in the vapor mixture.

61. A process as claimed in claim 57 in which the hydrogen gas from the oxidation-conversion zone is introduced to the vapor hydrogenation zone.

62. A process as claimed in claim 56 in which the carbonaceous material feed contains sulfur which reacts with hydrogen gas in the pyrolysis reaction zone to yield hydrogen sulfide gas, and comprising the additional step of removing the hydrogen sulfide from the volatilized hydrocarbons hydrogenated in the vapor hydrogenation zone by contacting a stream containing the volatilized hydrocarbons and hydrogen sulfide gas with an absorption solution in which hydrogen sulfide gas is soluble.

63. A continuous process for recovery of values contained in solid carbonaceous materials which comprises the steps of:

(a) providing a feed stream containing a particulate solid carbonaceous material;

(b) subjecting the particulate solid carbonaceous material to flash pyrolysis by continuously:

(i) transporting the particulate solid carbonaceous material containing feed stream contained in a carrier gas which is substantially nondeleteriously reactive with respect to products of pyrolysis of the particulate solid carbonaceous material to a solids feed inlet of a substantially vertically oriented, descending flow pyrolysis reactor having a substantially vertically oriented pyrolysis zone operated at a pyrolysis temperature of from about 600° to about 2000° F.;

(ii) feeding a particulate source of heat at a temperature above the pyrolysis zone temperature to a substantially vertically oriented chamber surrounding the upper portion of the pyrolysis reactor, the chamber having an inner peripheral wall forming an overflow weir to a vertically oriented mixing section of the vertically oriented decending flow pyrolysis reactor, the particulate heat source in said chamber being maintained in a fluidized state by the flow therewith of an aerating gas substantially nondeleteriously reactive with respect to the products of pyrolysis of the particulate solid carbonaceous material;

(iii) introducing steam to the annular chamber for forming hydrogen gas in said annular chamber by reacting a portion of said char with at least a portion of said steam;

(iv) discharging particulate source of heat and hydrogen gas from the annular chamber over said weir and downwardly into said mixing section at a rate sufficient to maintain said pyrolysis zone at the pyrolysis temperature;

(v) injecting the particulate solid carbonaceous material feed stream and carrier gas from the solids feed inlet into the mixing region to form a resultant turbulent mixture of the particulate source of heat, the particulate solid carbonaceous material feed and carrier gas;

(vi) passing the resultant turbulent mixture downwardly from said mixing section to the pyrolysis zone of said pyrolysis reactor to pyrolyze the particulate solid carbonaceous material while simultaneously hydrogenating pyrolysis products of the particulate solid carbonaceous material to yield a pyrolysis product stream containing as particulate solids the particulate source of heat and a carbon containing solid residue of pyrolysis of the particulate solid carbonaceous material, and a vapor mixture of carrier gas and pyrolytic vapors comprising hydrogenated volatilized hydrocarbons;

(c) passing the pyrolysis product stream from said pyrolysis reactor to a separation zone to separate at least the bulk of the particulate solids from the vapor mixture; and (d) forming the particulate source of heat by combining the separated particulate solids with a source of free oxygen in an amount sufficient to raise the solids to a temperature above the pyrolysis temperature.

64. A process as claimed in claim 63 in which the pyrolysis temperature is from about 600° to about 1400° F.

65. A process as claimed in claim 63 in which the pyrolysis temperature is from about 900° to about 1400° F.

66. A process as claimed in claim 63 in which the vapor mixture comprises unreacted hydrogen gas and including the steps of:

separating vapor mixture from carbon containing residue; and hydrogenating volatilized hydrocarbons in separated vapor mixture with hydrogen of the vapor mixture in the presence of catalyst in a vapor hydrogenation zone.

67. A process as claimed in claim 66 including the step of introducing a source of hydrogen gas to the vapor hydrogenation zone in addition to the unreacted hydrogen in the vapor mixture.

* * * * *